US012484651B2

(12) United States Patent
Mazzarolo et al.

(10) Patent No.: US 12,484,651 B2
(45) Date of Patent: Dec. 2, 2025

(54) PROTECTIVE HELMET

(71) Applicant: ALPINESTARS RESEARCH S.P.A., Maser (IT)

(72) Inventors: Giovanni Mazzarolo, Coste di Maser (IT); Roberto Parissenti, Sedico (IT); Andrea Baldan, Cassola (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 0 days.

(21) Appl. No.: 18/719,052

(22) PCT Filed: Jan. 17, 2023

(86) PCT No.: PCT/IB2023/050381
§ 371 (c)(1),
(2) Date: Jun. 12, 2024

(87) PCT Pub. No.: WO2023/139471
PCT Pub. Date: Jul. 27, 2023

(65) Prior Publication Data

US 2025/0049165 A1 Feb. 13, 2025

(30) Foreign Application Priority Data

Jan. 20, 2022 (IT) ..... 102022000000914

(51) Int. Cl.
*A42B 3/22* (2006.01)

(52) U.S. Cl.
CPC ..... *A42B 3/223* (2013.01); *A42B 3/221* (2013.01); *A42B 3/222* (2013.01)

(58) Field of Classification Search
CPC ..... A42B 3/223; A42B 3/221; A42B 3/222
See application file for complete search history.

(56) References Cited

U.S. PATENT DOCUMENTS 4,524,465 A * 6/1985 Huber ..... A42B 3/10 2/424
4,615,052 A * 10/1986 Nava ..... A42B 3/24 2/427

(Continued)

FOREIGN PATENT DOCUMENTS

DE 3007481 A1 9/1981
EP 1935267 B1 6/2012

OTHER PUBLICATIONS

International Search Report and Written Opinion of the International Application No. PCT/IB2023/050381, mailed Mar. 31, 2023, 11 pg.

*Primary Examiner* — Khaled Annis
(74) *Attorney, Agent, or Firm* — Fredrikson & Byron, P.A.

(57) ABSTRACT

Protective helmet to be worn and to protect the head of a user against impacts and including a rigid outer shell delimiting an inner space for housing the head of user and including a front opening. The protective helmet includes a shield removably coupled to the outer shell and adapted to move at least between an operative position wherein the shield covers the front opening without allowing entrance of air in the inner space and an inoperative position wherein the inner space is accessible from the outside through the front opening, the shield being provided with a front hole. The protective helmet includes a locking device to lock the shield in the operative position. The locking device is positioned on the outer shell and includes a rotatable engaging member to engage the front hole of the shield when in the operative position.

18 Claims, 8 Drawing Sheets

(56) References Cited

U.S. PATENT DOCUMENTS

| | | | | |
|---|---|---|---|---|
| 4,794,652 | A * | 1/1989 | Piech von Planta | A42B 3/326 2/424 |
| 4,860,389 | A * | 8/1989 | Morin | A42B 3/223 2/424 |
| 5,048,129 | A * | 9/1991 | Kamata | A42B 3/10 2/424 |
| 5,553,329 | A * | 9/1996 | Casartelli | A42B 3/223 2/424 |
| 9,504,288 | B2 | 11/2016 | Ratti et al. | |
| 2003/0051289 | A1 * | 3/2003 | Gafforio | A42B 3/222 2/424 |
| 2003/0088907 | A1 * | 5/2003 | Gafforio | A42B 3/222 2/424 |
| 2008/0141443 | A1 * | 6/2008 | Arai | A42B 3/222 2/424 |
| 2012/0117718 | A1 * | 5/2012 | Cho | A42B 3/223 2/424 |
| 2013/0239304 | A1 * | 9/2013 | Ratti | A42B 3/223 2/424 |
| 2014/0352020 | A1 * | 12/2014 | Isobe | A42B 3/223 2/9 |
| 2020/0275725 | A1 * | 9/2020 | Mazzarolo | A42B 3/32 |
| 2025/0049165 | A1 * | 2/2025 | Mazzarolo | A61F 9/025 |

* cited by examiner

PROTECTIVE HELMET

RELATED APPLICATIONS

This application is a 35 U.S.C. 371 national stage filing from International Application No. PCT/IB2023/050381, filed Jan. 17, 2023, which claims priority to Italian Patent Application No. 102022000000914, filed Jan. 29, 2022. The entire contents of each of these applications is incorporated herein by reference in their entirety.

FIELD OF THE INVENTION

The present invention relates to a protective helmet adapted to be worn by a user for protecting his/her head against impacts. In particular, even though not exclusively, the present invention relates to a full-face motorcycle helmet.

However, the helmet of the present invention could be also used in technical fields different from that indicated above, as for example skiing and cycling, provided that the outer shape of the helmet is suitably adapted.

BACKGROUND

As well known in the art, motorcycle helmets comprise essentially an outer shell made of a synthetic rigid material, an inner comfort liner adapted to be in contact with the user's head when the helmet is worn and an impact absorbing liner positioned between the outer shell and the comfort liner.

In the front portion of the helmet the outer shell is provided with a chin guard which is designed for protecting the chin of the user when the helmet is worn.

The outer shell delimits an inner space for housing the head of the user when the helmet is worn; the inner space is put in communication with the outside by a front opening and a bottom opening formed in the outer shell.

As well known, the helmets are intended to be worn in the right way by the user when the front opening is positioned at the face of the user, allowing him/her to view through the front opening.

Motorcycle helmets further comprise a shield removably coupled to the outer shell and movable with respect to the outer shell for passing from an operative and closed position to an inoperative position, and vice versa.

In the operative position the shield completely covers the front opening; in the inoperative position the shield does not cover the front opening or covers only partially the front opening, so the inner space is put in communication with and accessible from the outside through the front opening.

In the operative position, the shield prevents air from entering the inner space and thus the user usually maintains the shield in the operative position when he/she is riding the motorcycle.

In this regard, the helmet is further provided with sealings at the front opening which cooperate with the shield to prevent entrance of air inside the inner space.

The coupling between the shield and the outer shell is performed by means of suitable fastening means positioned at the opposite sides of the outer shell.

In particular, the shield comprises side portions hinged on the outer shell by means of the fastening means in order to be rotatable between the operative position and the inoperative position, and vice versa, about a respective axis passing through the fastening means.

The movement of the shield by rotation is performed by the user acting on the shield with the hand. The fastening means for motorcycle helmets are well known in the art and thus they will not be further disclosed in detail in the following.

A drawback of the above technical solutions is that the shield is maintained in the operative position only by means of the fastening means, which may be suitably configured in this regard.

This drawback may cause the unintentional or partial movement of the shield from the operative position to the inoperative position, particularly in case of a crash.

In order to at least partially overcome the above drawback, helmets have been provided that are equipped with locking devices or means for locking the shield in the operative position.

Generally, such locking devices or means are positioned both in the shield and in the outer shell, in particular at the chin guard, in reciprocally facing positions.

From U.S. Pat. No. 9,504,288 a helmet of the above type is known wherein the locking means comprise a hooking portion positioned in the shield or in the outer shell and a counter-hooking portion positioned in the outer shell or in the shield.

The hooking portion comprises two teeth and the counter-hooking portion comprises an element with a hole and a transverse portion intended to engage with the teeth.

By means of such locking means the shield may be positioned in two distinct engagement positions with respect to the outer shell, namely a first position wherein the shield fully adheres to the outer shell and is completely closed onto the front opening and a second position wherein the shield is only partially closed onto the front opening.

In the first position the shield completely prevents the entrance of air in the inner space; in the second position the shield defines a slit with the edge of front opening which allows air to partially enter in the inner space.

Further, the locking means comprise an actuating element, usually a push-button, suitable for being operated by the user in order to disengage the hooking portion from the counter-hooking portion.

A first drawback of this technical solution is that the provision of the locking means both in the shield and in the outer shell renders the structure of the helmet particularly complex, whereby the manufacture of the helmet becomes particularly time consuming and expensive.

Another drawback of the above technical solution is that the reliability of the actuating element may be compromised after a high number of utilizations.

BRIEF SUMMARIES OF OBJECTS OF THE INVENTION

The main object of the present invention is therefore to provide a protective helmet designed to overcome the drawbacks mentioned above.

More specifically, the main object of the present invention is to provide a protective helmet which allows the shield to be stably locked in the operative or closed position.

A further object of the present invention is to provide a protective helmet which allows the user to lock and unlock the shield from the outer shell easily and quickly.

Another object of the present invention is to provide a protective helmet whose manufacture is particularly simple and cost effective.

A further object of the present invention is to provide a protective helmet with a good reliability even after a large number of utilizations.

Another object of the present invention is to provide a protective helmet which allows the shield to be stably maintained in an engagement intermediate position wherein the entrance of air in the inner space through the front opening is at least partially allowed.

The above mentioned objects, and other objects that will better appear in the following description, are achieved by a protective helmet according to claim 1.

BRIEF DESCRIPTIONS OF THE DRAWINGS

The advantages and the characteristic features of the invention will appear more clearly from the following description of a preferred, but not exclusive, embodiment of the invention which refers to the accompanying figures in which.

Figure 1:
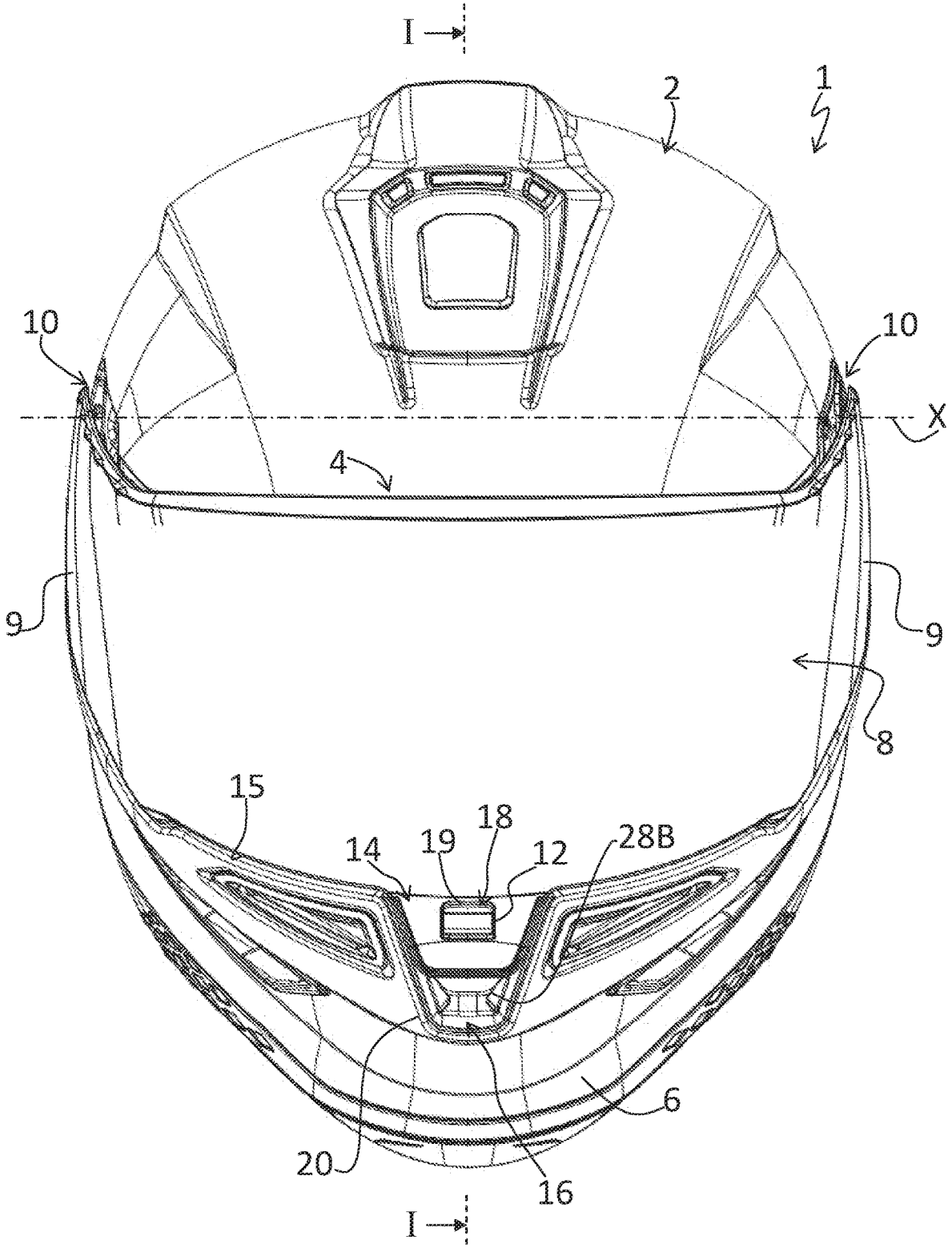
FIG. 1 is a front view of the protective helmet of the present invention.
Figure 3A:
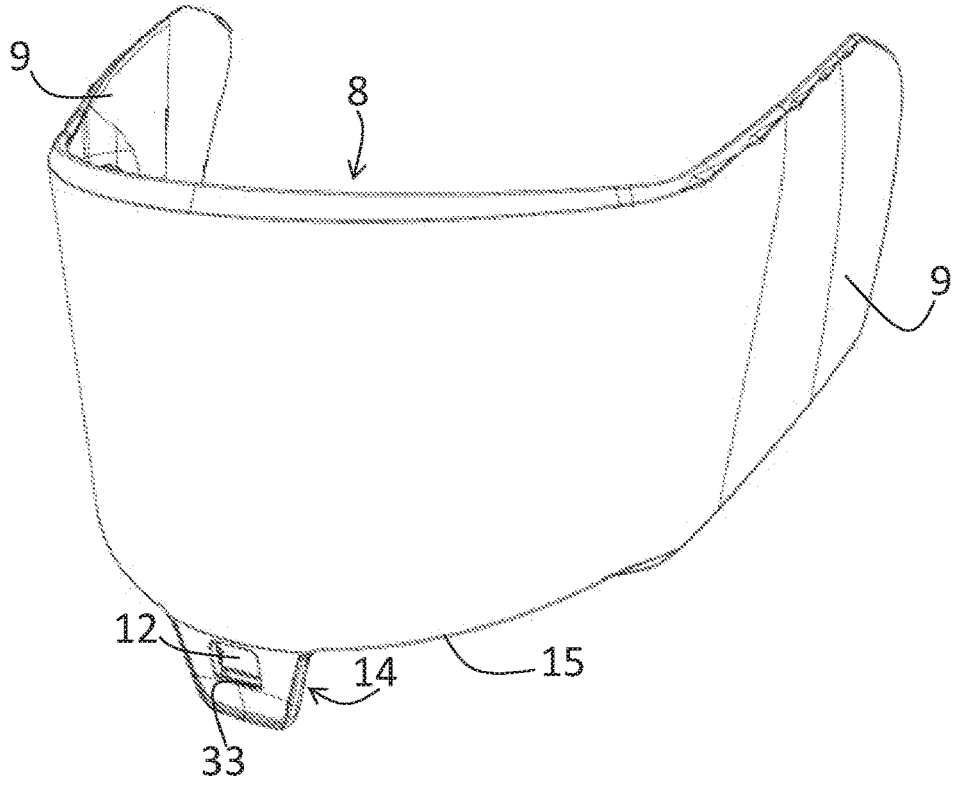
Figure 3B:
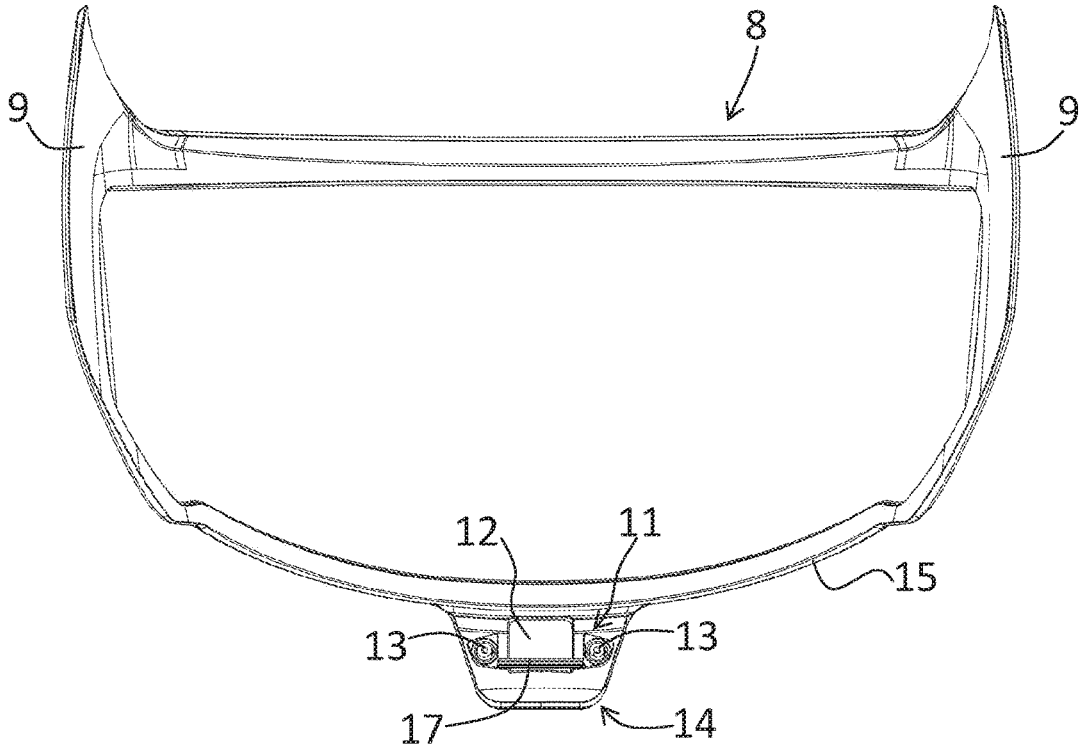
Figure 4:
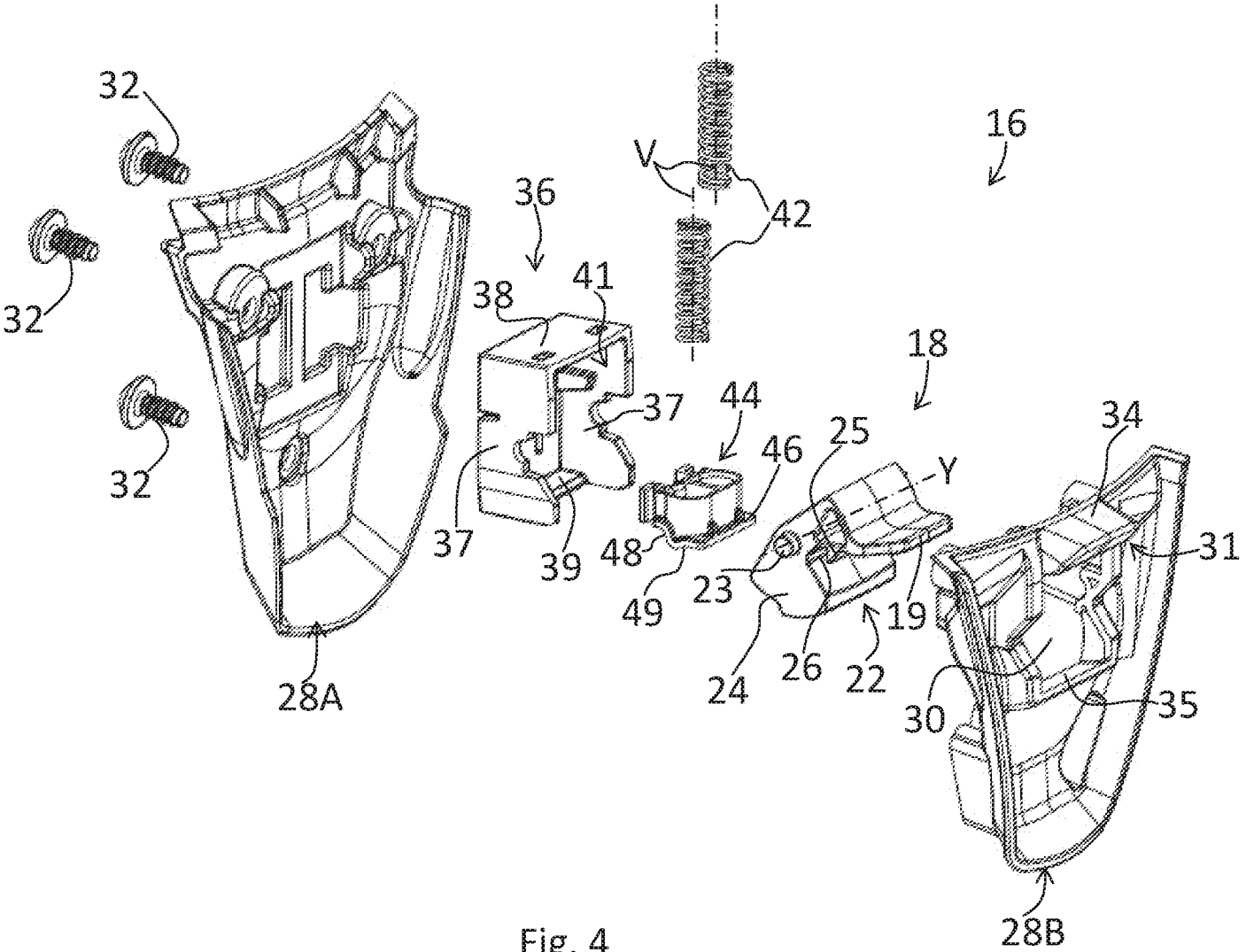
Figure 5:
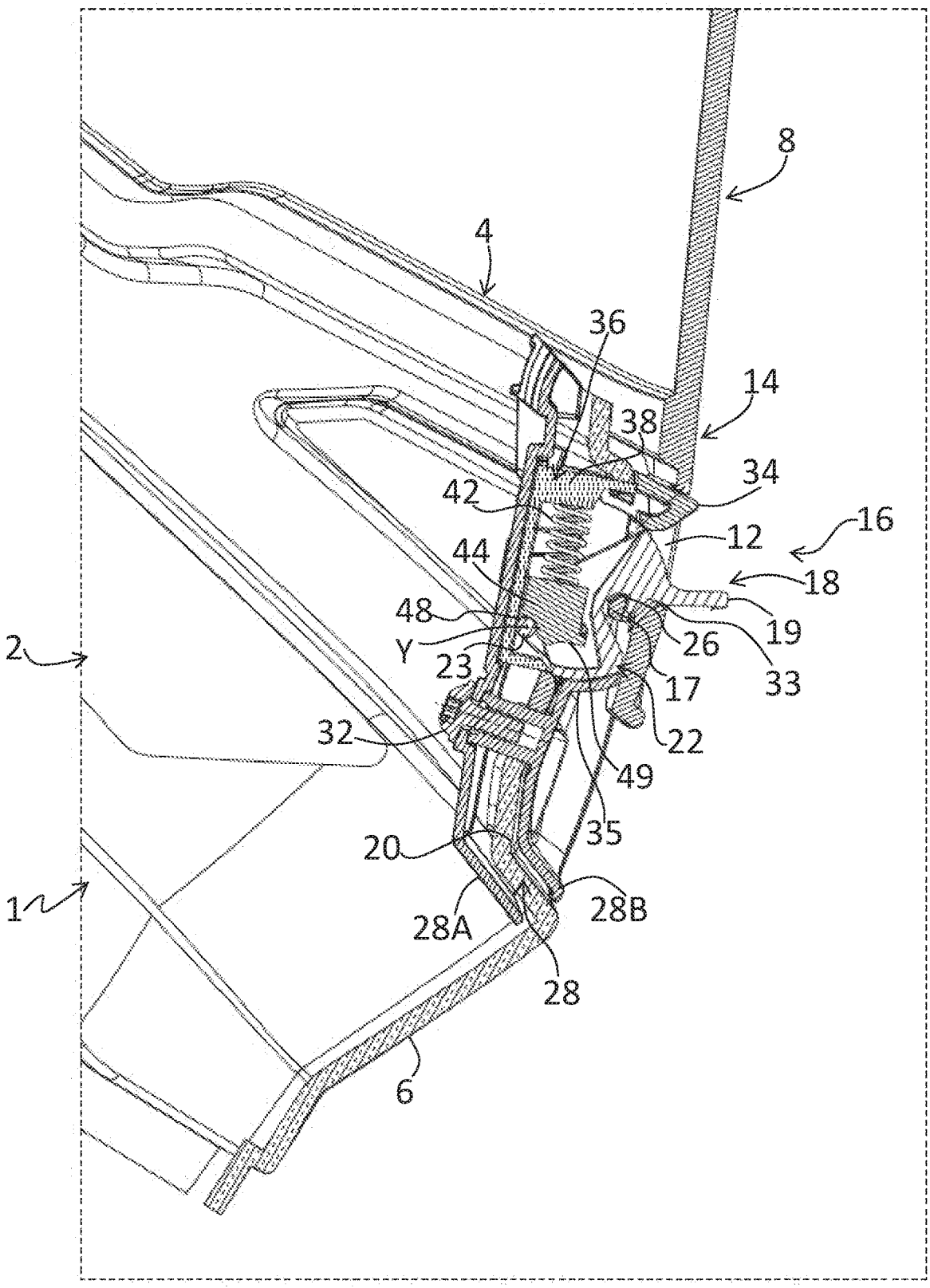
Figure 6:
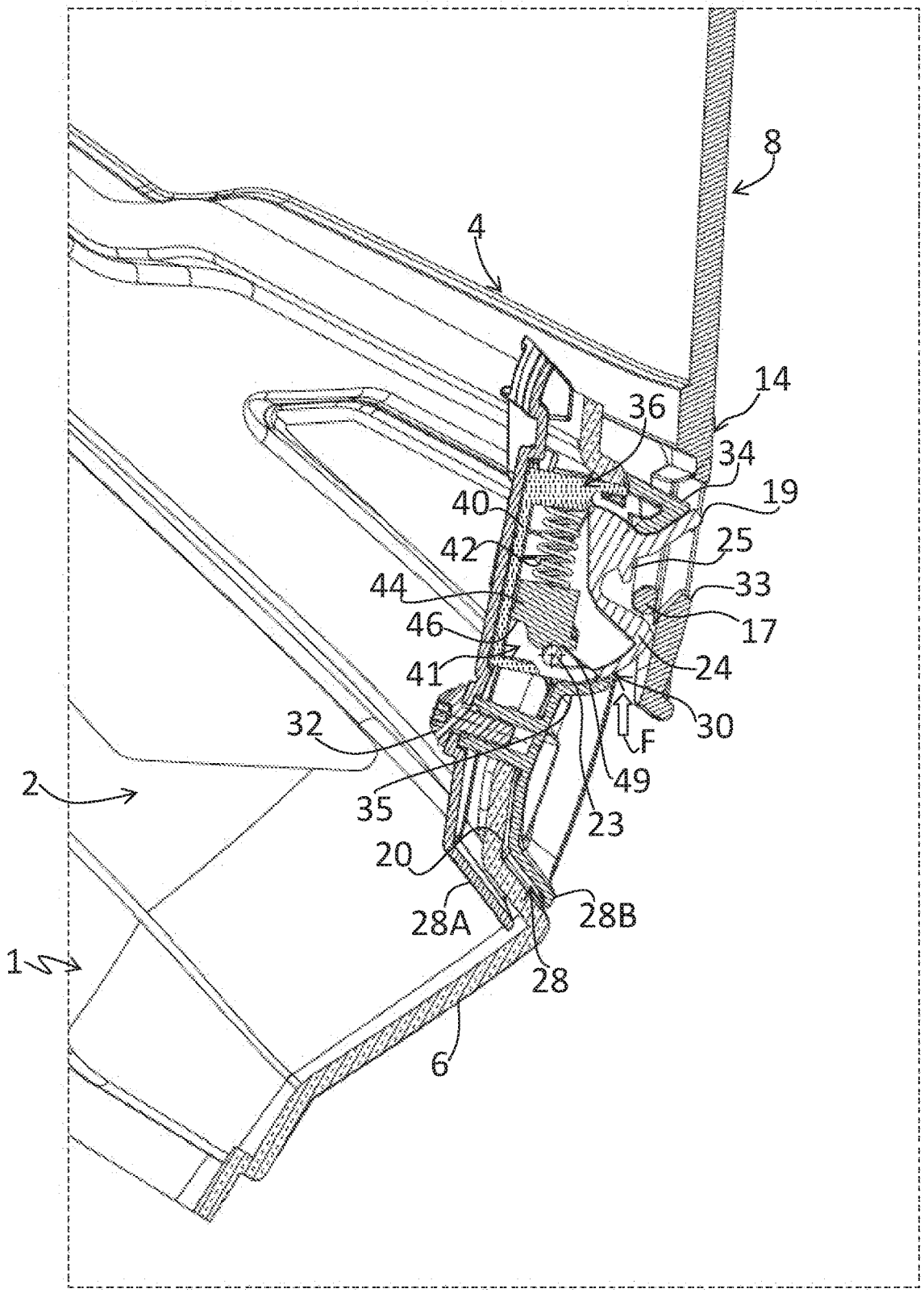
Figure 7:
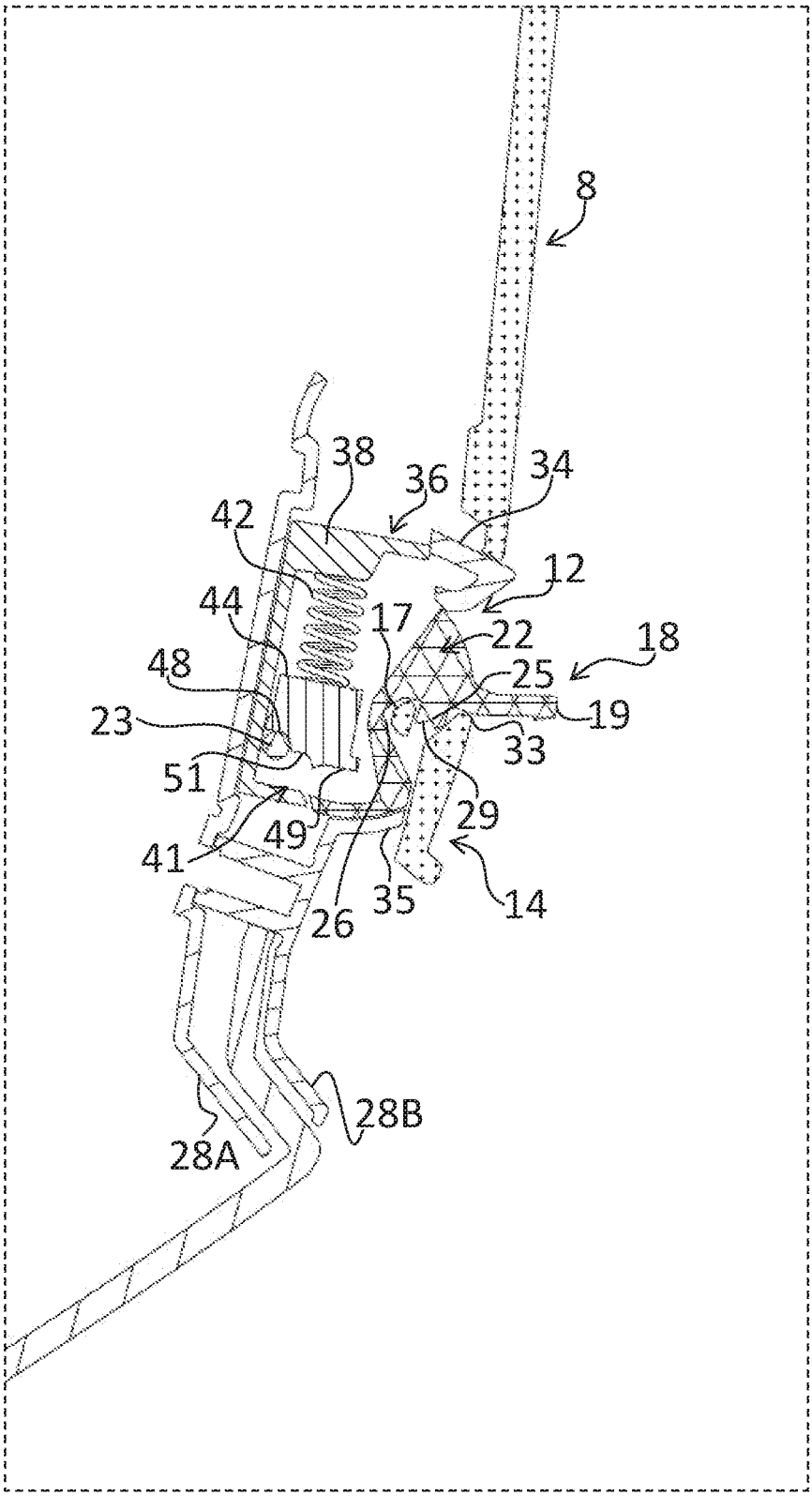
Figure 8:
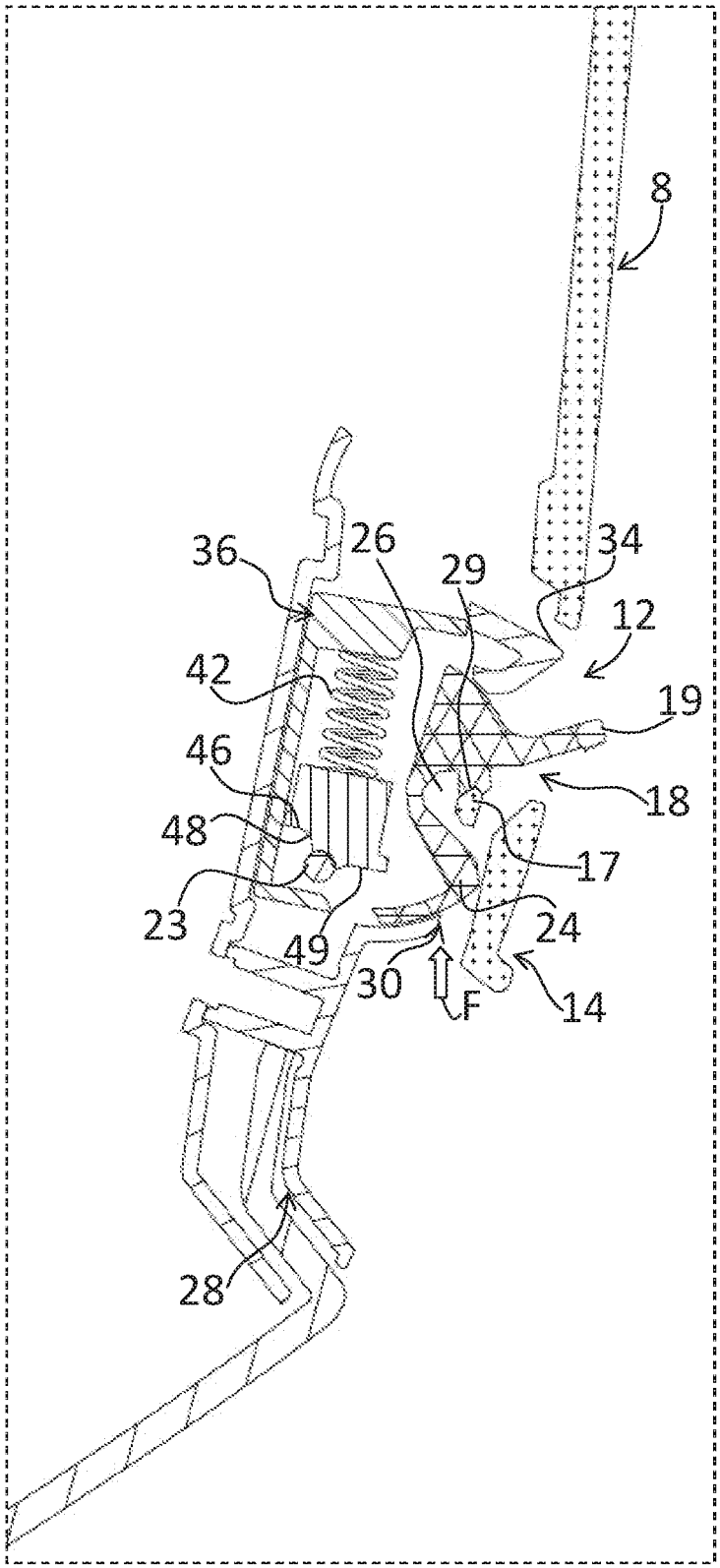

FIGS. 3*a* and 3*b* are respectively a perspective view and a rear view of the shield of the protective helmet of the present invention;

FIG. 4 is a perspective exploded view of the locking device of the protective helmet of the present invention;

FIGS. 5 and 6 are sectioned side views taken along the plan I-I shown in FIG. 1 of the locking device and of the shield according to a first embodiment and in different operating positions;

FIGS. 7 and 8 are sectioned side views of the locking device and of the shield according to a second embodiment and in different operating positions.

DETAILED DESCRIPTION OF EMBODIMENTS OF THE INVENTION

The present invention relates to a protective helmet adapted to be worn by a user and to protect the head of the user against impacts; in the following and in the attached figures the protective helmet is indicated as a whole with the reference number 1.

In particular, the protective helmet 1 of the present invention is a full-face motorcycle helmet adapted to be preferably worn by motorcyclists.

Nevertheless, the protective helmet 1 could be advantageously used by cyclists, skiers or in other sport fields where an effective protection of the user's head is needed.

The protective helmet 1 is designed to be attached to the user's head by attachment means, as for example chin straps, which are not illustrated in the attached figures.

As known, the protective helmet 1 comprises a rigid outer shell 2 made preferably of a composite or thermoplastic material and delimiting an inner space designed for housing the head of the user when the helmet 1 is worn.

In this regard, the outer shell 2 is dome-shaped so as to fit over the user's head, which is not shown in the attached figures.

The outer shell 2 comprises a front opening 4 adapted to put the inner space in communication with the outside. The inner space is in communication with the outside also through the bottom opening of the outer shell 2, through which the user inserts the head in the inner space.

For the purpose of the present specification, the protective helmet 1 is intended to be worn in the right way when the front opening 4 is positioned at the face of the user for allowing him/her to view there through.

In the front portion of the helmet 1, in particular below the front opening 4, the outer shell 2 may also comprise a chin guard 6 designed to be positioned at the chin of the user when the protective helmet 1 is worn.

As further known, the protective helmet 1 may also comprise:

- a comfort liner having an inner surface designed to be in contact with the user's head when the protective helmet 1 is worn by the user;
- an impact absorbing liner interposed between the outer shell 2 and the comfort liner and having an inner surface facing the outer surface of the comfort liner.

The comfort liner and the impact absorbing liner are located in the inner space and are not visible in the attached figures.

Figure 2:
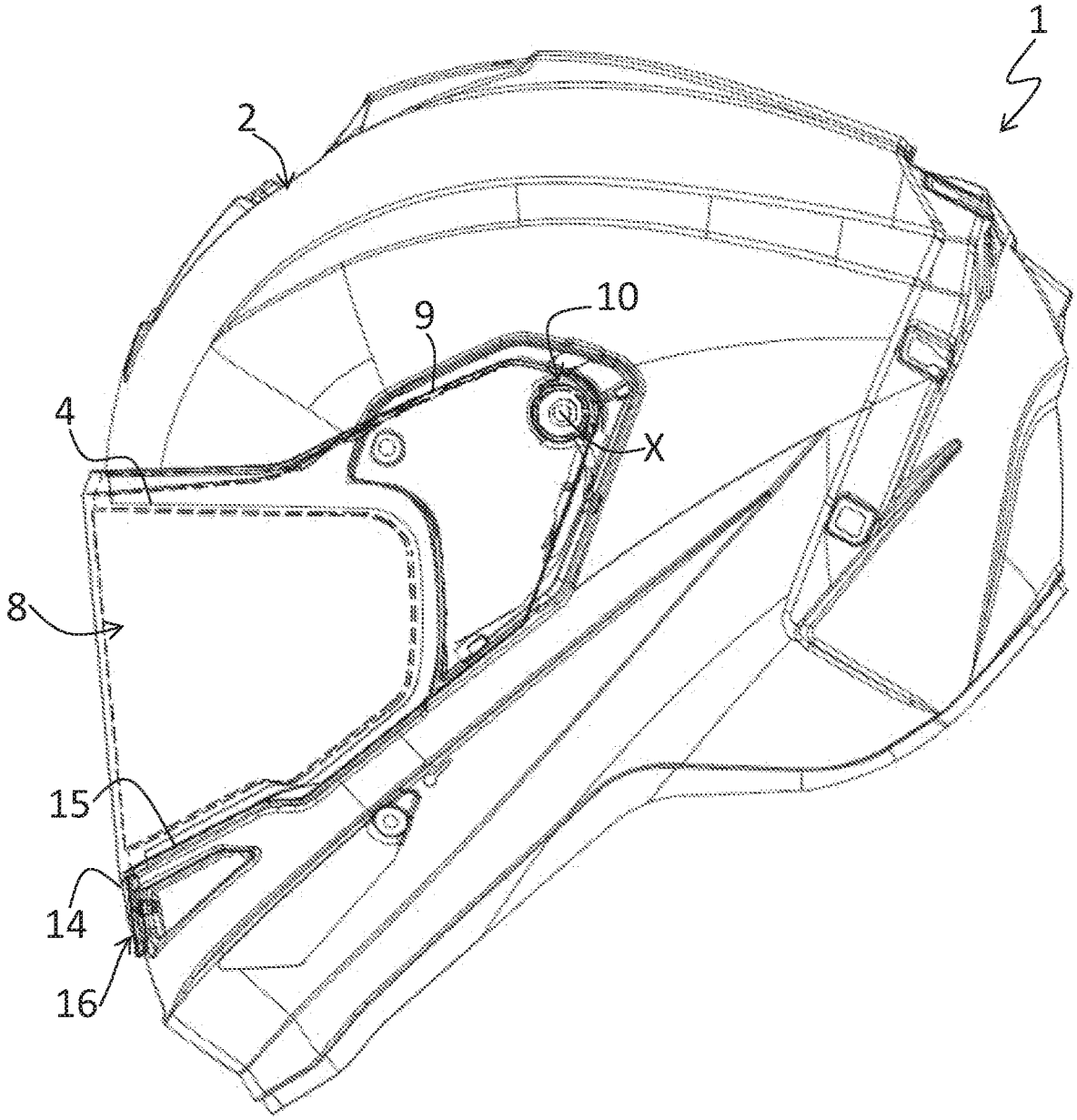
FIG. 2 is a side view of the protective helmet of FIG. 1.

The protective helmet 1 further comprises a shield 8 removably coupled to the outer shell 2; the shield 8 is shown coupled to the outer shell 2 in FIGS. 1 and 2 and alone in FIGS. 3*a* and 3*b*.

As well known in the art, the shield 8 is made of a rigid transparent material, preferably chosen in the group comprising acrylic material or polycarbonate.

The shield 8 coupled to the outer shell 2 is adapted to move at least between an operative position and an inoperative position.

In the operative position the shield 8 covers the front opening 4 and doesn't allow the entrance of air in the inner space. The operative position of the shield 8 is shown in FIGS. 1, 2, 5 and 7.

Usually, the user maintains the shield 8 in the operative position when he/she is riding the motorcycle.

In the inoperative position the front opening 4 is completely or at least partially free from the shield 8 and the inner space is in communication with the outside through the front opening 4. The inoperative position of the shield 8 is not shown in the attached figures.

Preferably, the shield 8 comprises side portions 9 removably coupled to the outer shell 2 by means of fastening means 10, schematically shown in FIGS. 1 and 2, in order to rotate about a respective rotation axis N passing through the fastening means 10.

Thus, the movement of the shield 8 performed by the user between the inoperative position and the operative position occurs by rotation of the shield 8 about the rotation axis X.

Further, the shield 8 is designed to move between the operative position and an intermediate position or between the inoperative position and the intermediate position in the same way as disclosed above with regard to the prior art.

In the intermediate position, the shield 8 covers the front opening 4 and at least partially allows flow of air in the inner space through the front opening 4.

The shield 8 in the intermediate position is shown in FIGS. 6 and 8, wherein the flow of air inside the protective helmet 1 is indicated with arrow F.

Contrary to the operative position, wherein the shield 8 adheres to the outer shell 2, in the intermediate position the shield 8 is detached from the outer shell 2 in the way explained below.

The intermediate position, also known in jargon as "city position", allows the motorcyclist to ride at relative low speed (for example about 80/100 km/h) with his/her face protected by the shield but still having airflow demisting the shield.

As better shown in FIGS. 1, 3*a*-3*b*, 5-6 and 7-8, the shield 8 is further provided with a front hole 12. In particular, the front hole 12 is formed on a projection 14 positioned at the lower edge 15 of the shield 8.

In the context of the present specification, the lower edge 15 of the shield 8 is intended as the edge close to the chin guard 6 of the outer shell 2.

The projection 14 is adapted to be positioned in front of the outer shell 2 in the area below the front opening 4, in particular in front of the chin guard 6, when the shield 8 is in the operative position or in the intermediate position, as better shown in FIGS. 5-8.

Further, the projection 14 comprises a bulge 17 positioned on the inner face thereof, as better shown in FIGS. 3*b*, 5-6 and 7-8.

In particular and as better shown in FIG. 3*b*, the bulge 17 is preferably formed on a member 11 made of steel and fixed to the inner side of the projection 14 by means of hot/ultrasonic deformation or riveting of two pins 13 so as the bulge 17 is located underneath the front hole 12.

The protective helmet 1 further comprises a locking device 16 designed to lock the shield 8 in the operative position. The locking device 16 as a whole and all the components thereof, which will be described in detail in the following, are better visible in the perspective exploded view of FIG. 4.

According to a peculiar feature of the invention, the locking device 16 is positioned on the outer shell 2.

In particular, as better illustrated in FIGS. 1-2 and 5-6, the locking device 16 is positioned in a housing 20 formed in the chin guard 6 such that the projection 14 with the hole 12 is adapted to be positioned in front of the locking device 16 when the shield 8 is in the operative position.

The locking device 16 comprises a rotatable engaging member 18 designed to engage the front hole 12 of the shield 8 when the shield 8 is in the operative position.

In the intermediate position, the projection 14 of the shield 8 is located as well in front of the locking device 16 but the engaging member 18 does not engage the front hole 12, as better illustrated in FIG. 6 and in FIG. 8.

Preferably, the engaging member 18 comprises an appendix 19 designed to engage the front hole 12 when the shield 8 is in the operative position and a body 22 rotatable about a rotation axis Y.

Advantageously, the body 22 is provided with pins 23 at the opposite sides and the rotation axis Y thereof is parallel to the rotation axis N of the fastening means 10 described above.

As better illustrated in FIG. 4-8, the rotatable body 22 also comprises a shaped bottom part 24 and a rib 25 interposed between the appendix 19 and the shaped bottom part 24.

The rib 25 delimits, in combination with the shaped bottom part 24, a slot 26 which extends along a direction parallel to the rotation axis Y. The function of the rib 25 and of the slot 26 will be better explained in the following.

Further, in the embodiment of the helmet shown in FIGS. 7 and 8, the rib 25 may further comprise a groove 29 located at the lower end of the rib 25 and whose function will be better explained in the following as well.

The locking device 16 further comprises a casing 28 secured to the outer shell 2; in particular the casing 28 is positioned in the housing 20 of the chin guard 6 disclosed above.

The engaging member 18, in particular the appendix 19 thereof, at least partially projects from the casing 28, as visible in FIGS. 5-6 and 7-8.

In particular, the engaging member 18 at least partially projects from a front aperture 30 provided in the casing 28 and the front hole 12 of the shield 8 faces the front aperture 30 when the shield 8 is at least in the operative position, more particularly in the operative position and in the intermediate position, as shown in FIGS. 5-6 and 7-8.

Preferably, and as better shown in FIG. 4, the casing 28 comprises an inner half-shell member 28A secured on the shell 2, namely on the outer surface of the shell 2, and an outer half-shell member 28B secured to the inner half-shell member 28A and facing outward.

Thus, in the assembled configuration the only part of the casing 28 visible from outside is the outer half-shell member 28B, as shown in FIGS. 1 and 2.

The front aperture 30 disclosed above is formed in the outer half-shell member 28B and the two half-shell members 28A, 28B may be coupled there between by suitable connecting means 32, as for example screws, shown in FIG. 4-6.

Further, the outer surface of the outer half-shell member 28B comprises a projecting portion 34 positioned at the upper edge 31 of the front aperture 30. The projecting portion 34 is better shown in FIGS. 4-8.

The locking device 16 may further comprise a box-like member 36 positioned inside the casing 28 and comprising at least side walls 37 and an inner wall 40 which delimit a cavity 41.

The box-like member 36 is better visible as well in FIGS. 4-8.

In particular, the cavity 41 of the box-like member 36 is delimited by a pair of side walls 37, an upper wall 38, a bottom wall 39 and the inner wall 40.

Suitably, the box-like member 36 is positioned in the casing 28 with the cavity 41 oriented towards the outer half-shell member 28B.

According to such an arrangement, the side walls 37 and the inner wall 40 of the box-like member 36 extend on a substantially vertical plan and the upper wall 38 and bottom wall 39 extend on a substantially horizontal plan.

Such an arrangement has to be intended with reference to the protective helmet 1 worn by the user.

The pins 23 of the body 22 are rotatably supported by the side walls 37 of the box-like member 36 and the body 22 is at least partially positioned inside the cavity 41 of the box-like member 36.

Preferably, the locking device 16 further comprises elastic means 42 positioned in the casing 28 and whose function will be further explained below. These elastic means 42 are better shown in FIGS. 4-8.

In particular, the elastic means 42 are formed by at least one or more springs positioned in the box-like member 36 and having vertical axes of extension V. In the embodiment shown in the figures, the elastic means 42 comprise a pair of springs 42.

The springs 42 have upper ends abutting against the upper wall 38 of the box-like member 36 and lower ends housed inside a base member 44 positioned in the box-like member 36 as well. The springs 42 and the base member 44 are better shown in the FIGS. 4-8.

Further, in the embodiment shown in FIGS. 4-6 the base member 44 has a bottom wall 46 with a first seat 48 and a second seat 49 facing the bottom wall 39 of the box-like member 36.

In particular, the first seat 48 is formed in the bottom wall 46 in a position close to the inner wall 40 of the box-like member 36 in assembled configuration; the second seat 49 is formed in the bottom wall 46 in a position distanced from the inner wall 40 of the box-like member 36 in assembled configuration.

In the embodiment shown in FIGS. 7 and 8, the base member 44 has a bottom wall 46 with a first seat 48, a second seat 49 and a third seat 51 interposed between the first seat 48 and the second seat 49.

The engaging member 18 is designed to be moved between an operative configuration when the shield 8 is in the operative position (see FIGS. 5 and 7) and an inoperative configuration when the shield 8 is in the intermediate position (see FIGS. 6 and 8).

Thus, when the engaging member 18 moves from the inoperative configuration to the operative configuration the body 22 rotates downwards about the rotation axis Y and when the engaging member 18 moves from the operative configuration to the inoperative configuration the body 22 rotates upwards about the rotation axis Y.

As can be seen from FIGS. 5-6 and 7-8, in the operative configuration the appendix 19 of the engaging member 18 is located at a lower position than in the inoperative configuration, namely in a position closer to the bottom end of the projection 14 of the shield 8.

As the appendix 19 is always accessible through the front hole 12 when the shield 8 is in the operative position and in the intermediate position, the rotation of the body 22 is performed by the user acting directly on the appendix 19 with the finger.

As shown in FIGS. 5 and 7, the lower surface of the appendix 19 abuts against the bottom edge 33 of the front hole 12 of the shield 8 when the engaging member 18 is in the operative configuration.

Further, in this configuration:

- the bottom part 24 of the body 22 is in contact with the inner side of the projection 14 and does not project from the bottom edge 35 of the front aperture 30 of the casing 28;
- the inner bulge 17 of the projection 14 is positioned in the slot 26 of the rotatable body 22 and the rib 25 abuts there against, with the shield 8 in the operative position.

As shown in the embodiment of FIG. 6, the upper surface of the appendix 19 abuts against the outer surface of the casing 28, namely against the projecting portion 34 thereof, when the engaging member 18 is the inoperative configuration and the shield 8 is in the intermediate position.

In this latter regard, the shape of the upper surface of the appendix 19 and the shape of the projecting portion 34 are substantially complementary.

Further, in the intermediate position the bottom part 24 of the body 22 remains in contact with the inner side of the projection 14 and projects from the bottom edge 35 of the front aperture 30, thus maintaining the shield 8 detached and distanced from the outer shell 2 in order to form a passage for air within the inner space of the helmet 1.

Opportunely, in the first embodiment of FIGS. 5 and 6, the pins 23 of the rotatable body 22 supported by the side walls 37 of the box-like member 36 are also positioned in the first seat 48 when the engaging member 18 is in the operative configuration (see FIG. 5) and in the second seat 49 when the engaging member 18 is in the inoperative configuration (see FIG. 6).

Thus, the pins 23 are designed to move from the first seat 48 to the second seat 49 upon rotation of the body 22 for bringing the engaging member 18 from the operative configuration to the inoperative configuration.

In the second embodiment of the FIGS. 7 and 8, the groove 29 formed in the rib 25 engages the upper edge of the bulge 17 when the engaging member 18 is in the inoperative configuration and the shield 8 is in the intermediate position (see FIG. 8).

In this configuration, the accidental rotation of the rotatable body 22 and the lift of the shield 8 from the intermediate position are prevented by the projecting portion 34 and the bulge 17 stably holding the rotatable body 22.

At this point, the rotation of the rotatable body 22 may be only performed by the user pulling up the appendix 19 with his fingers for bringing the shield 8 in the inoperative position. Further, in the second embodiment of FIGS. 7 and 8, the pins 23 of the rotatable body 22 are positioned in the first seat 48 when the engaging member 18 is in the operative configuration (see FIG. 7) and in the third seat 51 when the engaging member 18 is in the inoperative configuration (see FIG. 8).

When the user pulls up the appendix 19 as indicated above, the pins 23 of the rotatable body 22 move from the third seat 51 to the second seat 49, according to a configuration not illustrated in the figures.

Further, in both the embodiments the elastic means 42 are designed for stably blocking the engaging member 18 in the operative configuration and in the inoperative configuration.

The above configuration of the box-like member 36, of the base member 44 and of the elastic means 42 compressing the base member 44 downwards against the pins 23 positioned in one of the seats 48, 49, 51 allows to stably maintain the engaging member 18 in the operative configuration and in the inoperative configuration.

Operatively the user, once having worn the protective helmet 1, may bring the shield 8 from the inoperative position to the intermediate position by rotating it about the axis X passing through the fastening means 10.

As disclosed above, in the intermediate position the front hole 12 of the shield 8 faces the front aperture 30 of the casing 28 from which the engaging member 18, namely the appendix 19, projects, thus allowing the appendix 19 to be accessible from the outside (see FIGS. 6 and 8).

At this point, the user may push the appendix 19 downwards, thus causing the rotation of the body 22 about the axis Y and inside the cavity 41 of the box-like member 36, in order to lock the engaging member 18 in the operative configuration disclosed above (see FIGS. 5 and 7).

If the user wants to bring the shield 8 in the inoperative position again, firstly he/she has to pull the appendix 19 upwards until the engaging member 18 reaches the inoperative configuration and then move the shield 8 from the intermediate position to the inoperative position.

It is clear now how the present invention allows to achieve the predefined objects.

As can be seen from the above description the components of the locking device are all positioned on the outer shell; this arrangement allows to have a protective helmet whose manufacture has a reduced complexity.

Further, the locking device configured as disclosed above allows to stably retain the shield in the operative position and in the intermediate position without render the structure of the helmet particularly complex.

Further, the box-like member, the base member and the elastic means configured as disclosed above provides various support points for the rotatable body of the engaging member and thus allow to stably maintain the engaging member in the operative and in the inoperative configuration.

With regard to the embodiments of the protective helmet described above, the person skilled in the art may, in order to satisfy specific requirements, make modifications to and/or replace elements described with equivalent elements, without thereby departing from the scope of the accompanying claims.

The invention claimed is:

1. A protective helmet adapted to be worn by a user and to protect the head of the user against impacts, the protective helmet comprising:

a rigid outer shell delimiting an inner space for housing the head of user, the outer shell comprising a front opening;

a shield removably coupled to the outer shell and adapted to move at least between an operative position wherein the shield covers the front opening and prevents entrance of air into the inner space and an inoperative position wherein the inner space is in communication with the outside through the front opening, the shield being provided with a front hole;

a locking device to lock the shield in the operative position;

characterized in that the locking device is positioned on the outer shell and comprises a rotatable engaging member to engage the front hole of the shield when in the operative position.

2. The helmet according to claim 1, characterized in that said engaging member comprises a body rotatable about a rotation axis and an appendix to engage said front hole when the shield is in the operative position.

3. The helmet according to claim 1, characterized in that the locking device comprises a casing secured on the outer shell, the rotatable engaging member at least partially projecting from the casing.

4. The helmet according to claim 3, characterized in that the casing is provided with a front aperture the engaging member projects from, the front hole of the shield facing the front aperture at least when the shield is at least in the operative position.

5. The helmet according to claim 4, characterized in that the casing comprises an inner half-shell member secured on the outer shell and an outer half-shell member secured on the inner half-shell member and facing outward, the front aperture being formed on the outer half-shell member.

6. The helmet according to claim 1, characterized in that the shield is able to move between said operative position and an intermediate position or between said inoperative position and the intermediate position, the shield covering the front opening and partially allowing flow of air inside the inner space in the intermediate position.

7. The helmet according to claim 6, characterized in that the engaging member is able to be moved between an operative configuration when the shield is in said operative position and an inoperative configuration when the shield is in the intermediate position.

8. The helmet according to claim 7, characterized in that in the operative configuration the lower surface of the appendix abuts against the bottom edge of the front hole.

9. The helmet according to claim 8, characterized in that in the inoperative configuration the upper surface of the appendix abuts against the outer surface of the casing.

10. The helmet according to claim 2, characterized in that the engaging member is able to be moved between an operative configuration when the shield is in said operative position and an inoperative configuration when the shield is in the intermediate position, and characterized in that when the engaging member moves from the inoperative configuration to the operative configuration the body rotates downwards about the rotation axis and when the engaging member moves from the operative configuration to the inoperative configuration the body rotates upwards about the rotation axis.

11. The helmet according to claim 7, characterized in that the locking device comprises elastic means for stably blocking the engaging member in the operative configuration and in the inoperative configuration.

12. The helmet according to claim 7, characterized in that the locking device comprises a box-like member positioned inside the casing and comprising at least side walls and an inner wall delimiting a cavity.

13. The helmet according to claim 12, characterized in that the rotatable body has respective pins on the opposite sides which are rotatably supported by the side walls of the box-like member, the rotatable body being at least partially positioned inside the cavity.

14. The helmet according to claim 13, characterized in that the locking device comprises elastic means for stably blocking the engaging member in the operative configuration and in the inoperative configuration, the elastic means comprising one or more of springs positioned in the box-like member, the springs having lower ends housed inside a base member positioned in the box-like member.

15. The helmet according to claim 14, characterized in that the base member has a bottom wall with a first seat and a second seat, the pins of said rotatable body being positioned in the first seat when the engaging member is in the operative configuration and in the second seat when the engaging member is in the inoperative configuration.

16. The helmet according to claim 14, characterized in that the base member has a bottom wall with a first seat, a second seat and a third seat interposed between the first seat and the second seat, the pins of said rotatable body being positioned in the first seat when the engaging member is in the operative configuration and in the third seat when the engaging member is in the inoperative configuration.

17. The helmet according to claim 2, characterized in that the engaging member is able to be moved between an operative configuration when the shield is in said operative position and an inoperative configuration when the shield is in the intermediate position, and characterized in that the rotatable body comprises a rib which delimits a slot, the front hole of the shield being formed on a projection comprising an inner bulge positioned in said slot with the rib abutting there against when the shield is in the operative position.

18. The helmet according to claim 17, characterized in that the rib comprises a groove located at the lower end of the rib, the groove engaging the upper edge of the bulge when the engaging member is in the inoperative configuration.

* * * * *